US011298285B2

(12) United States Patent
Lerner

(10) Patent No.: US 11,298,285 B2
(45) Date of Patent: Apr. 12, 2022

(54) ANKLE EXOSKELETON SYSTEM AND METHOD FOR ASSISTED MOBILITY AND REHABILITATION

(71) Applicant: Arizona Board of Regents on Behalf of Northern Arizona University, Flagstaff, AZ (US)

(72) Inventor: Zachary F Lerner, Flagstaff, AZ (US)

(73) Assignee: ARIZONA BOARD OF REGENTS ON BEHALF OF NORTHERN ARIZONA UNIVERSITY, Flagstaff, AZ (US)

( * ) Notice: Subject to any disclaimer, the term of this patent is extended or adjusted under 35 U.S.C. 154(b) by 169 days.

(21) Appl. No.: 16/353,133

(22) Filed: Mar. 14, 2019

(65) Prior Publication Data

US 2019/0282424 A1 Sep. 19, 2019

Related U.S. Application Data

(60) Provisional application No. 62/644,163, filed on Mar. 16, 2018.

(51) Int. Cl.
*A61H 1/02* (2006.01)
*A61H 3/00* (2006.01)

(52) U.S. Cl.
CPC ..... *A61H 1/0266* (2013.01); *A61H 3/00* (2013.01); *A61H 2003/007* (2013.01); *A61H 2201/1207* (2013.01); *A61H 2201/14* (2013.01); *A61H 2201/165* (2013.01); *A61H 2201/1642* (2013.01); *A61H 2201/5007* (2013.01); *A61H 2201/5061* (2013.01); *A61H 2201/5071* (2013.01)

(58) Field of Classification Search
CPC .. A61H 1/0237; A61H 1/0262; A61H 1/0266; A61H 3/00; A61H 3/008; A61H 2003/007; A61H 2201/50; A61H 2201/5074; A61H 2201/018; A61H 2201/1642; A61H 2201/164; A61H 2201/501; A61H 2201/5058; A61H 2201/5071; A61H 2201/1652; A61H 2201/5061; A61H 2201/1207; A61H 2201/14; A61H 2201/5007; A61H 2003/001; A61F 2/60; A61F 2002/607; B25J 9/0006
See application file for complete search history.

(56) References Cited

U.S. PATENT DOCUMENTS

| | | | | |
|---|---|---|---|---|
| 8,114,034 | B2 * | 2/2012 | Ikeuchi | A61H 1/024 601/5 |
| 10,517,788 | B2 * | 12/2019 | Lee | F16H 19/06 |
| 10,561,564 | B2 * | 2/2020 | LaChappelle | A61F 2/60 |
| 2003/0115031 | A1 | 6/2003 | Dariush et al. | |
| 2004/0249316 | A1 | 12/2004 | Ashihara et al. | |
| 2005/0059908 | A1 * | 3/2005 | Bogert | A61H 3/00 601/5 |

(Continued)

*Primary Examiner* — Justine R Yu
*Assistant Examiner* — Kelsey E Baller
(74) *Attorney, Agent, or Firm* — Quarles & Brady LLP

(57) ABSTRACT

A powered exoskeleton is designed to provide assistance to a user, where the powered exoskeleton may have power-generating elements in one location and power-applying elements in another location, so that a user can easily wear the powered exoskeleton.

8 Claims, 11 Drawing Sheets

(56) References Cited

U.S. PATENT DOCUMENTS

| | | | | |
|---|---|---|---|---|
| 2012/0289870 | A1* | 11/2012 | Hsiao-Wecksler | A61H 1/0266 601/5 |
| 2013/0053736 | A1* | 2/2013 | Konishi | H01M 10/482 601/34 |
| 2013/0158444 | A1* | 6/2013 | Herr | A63B 21/00181 601/23 |
| 2013/0226048 | A1 | 8/2013 | Unluhisarcikli et al. | |
| 2015/0321342 | A1 | 11/2015 | Smith et al. | |
| 2015/0374573 | A1* | 12/2015 | Horst | A61F 5/0125 602/16 |
| 2016/0143800 | A1 | 5/2016 | Hyung et al. | |
| 2017/0119613 | A1* | 5/2017 | Roh | A61H 1/0244 |
| 2017/0196751 | A1* | 7/2017 | Smith | A63B 21/0004 |
| 2017/0202725 | A1 | 7/2017 | Robertson et al. | |
| 2017/0273853 | A1* | 9/2017 | Nagata | A61B 5/1114 |
| 2018/0055711 | A1* | 3/2018 | Choi | B25J 9/1694 |
| 2018/0161188 | A1* | 6/2018 | Zistatsis | A61H 1/0244 |
| 2018/0168907 | A1* | 6/2018 | Huang | A61H 1/0288 |
| 2018/0177672 | A1 | 6/2018 | Uchida et al. | |
| 2019/0232485 | A1* | 8/2019 | Reese | B25J 9/0057 |
| 2020/0039061 | A1 | 2/2020 | Sankai | |

* cited by examiner

FIG. 10

1300

| | Target Ankle Properties (Peak) | Exoskeleton Ankle Actuator Properties | Ankle Properties for Children with CP (Peak) | Combined Exo + Ankle (CP) Properties |
|---|---|---|---|---|
| Torque (Nm) | 23-46 | 0-15 | 14-28 | 14-43 |
| Peak Power (W) | 50-100 | 0-60 | 23-46 | 23-106 |

ANKLE EXOSKELETON SYSTEM AND METHOD FOR ASSISTED MOBILITY AND REHABILITATION

CROSS-REFERENCE TO RELATED APPLICATION

This application claims priority to U.S. Provisional Application No. 62/644,163 filed on Mar. 16, 2018, the entire contents of which is incorporated herein by reference.

BACKGROUND

A number of injuries or conditions can lead to disorders, such as cerebral palsy (CP), that affect muscle control. Individuals with muscle control disorders such as CP frequently experience a downward trend of reduced physical activity and worsening of gait function leading to a permanent decline in ambulatory ability. FIG. 1, for example, depicts a sequence of events that can ultimately lead to loss of ambulatory ability. Specifically, in some individuals, diminished ankle functionality results from lack of muscle strength, can lead to elevated energy costs associated with transport that, in turn, leads to reduced physical activities. The reduced physical activities lead, in turn, to secondary health issue, muscle weakness, and reduced gait function leading to loss of ambulatory function. FIG. 2A is a chart depicting typical reductions in steps taken for individuals having muscle control disorders as compared to individuals without muscle control disorders. For children with CP, for example, walking can be drastically more energetically expensive than for their typically developing peers. Muscle strength and endurance do not increase in proportion to body mass during growth, factors contributing to declining walking ability. The ability to walk is critical for physical health and general well-being across the life-span. Reduced level of weight-bearing physical activity contributes to a wide range of secondary conditions associated with CP, such as metabolic dysfunction, cardiovascular disease, fatigue, weakness, osteoporosis, and chronic pain.

By improving walking economy, individuals with CP may engage in greater amounts of habitual physical activity. This may prolong walking ability and have many additional physical and mental health benefits, such as increasing muscle and bone mass. Additionally, increased daily activity would likely also have rehabilitation related benefits, including maintenance or improvement of baseline walking ability, by increasing muscle strength and coordination.

A powered exoskeleton is a wearable, mobile device that allows a user to perform limb motions with additional external power, for increasing a user's strength or endurance. Powered exoskeleton usage may include rehabilitation, assistance, and enhancement of a user's capabilities.

SUMMARY

The above features and advantages of the present invention will be better understood from the following detailed description taken in conjunction with the accompanying drawings.

In accordance with an embodiment, a wearable assistance device may include a battery, a motor, a cable, a first arm, a second arm, a rotational bearing, a sensor, and a controller. The motor may be electrically coupled to the battery. The cable may be coupled to the motor at a first end of the cable. The first arm may be configured to removably couple to a lower leg of a user. The second arm may be coupled to a second end of the cable, and the second arm may be configured to be positioned underneath a foot of the user. The rotational bearing may rotationally couple the first arm to the second arm. The sensor may be coupled to the rotational bearing or the second arm, and the sensor may be configured to measure a torque applied to the sensor or a pressure applied to the sensor. The controller may be electrically coupled to the motor. The controller may be configured to receive data from the sensor, to determine a current state value using the data from the sensor, to determine a control instruction based at least on the current state value, and to control an operation of the motor based on the control instruction.

In accordance with an example embodiment, a system may include a motor, a force-transmitting linkage, a lower assembly, a controller, and a sensor. The force-transmitting linkage may be mechanically coupled to the motor. The lower assembly may include a joint mechanically coupled to the force-transmitting linkage, and the lower assembly may be configured to engage a foot of a user. The controller may be communicably coupled to the motor, and the controller may be configured to transmit an instruction to the motor. The sensor may be coupled to the lower assembly and communicably coupled to the controller, and the sensor may be configured to detect motion or force of the joint. The controller may be configured to receive data from the sensor, and the controller may be configured to use the data to determine the instruction to be transmitted to the motor.

In accordance with an example embodiment, a method of providing assistance to a user may include receiving data from a sensor coupled to a lower assembly, with the lower assembly including a joint mechanically coupled to a force-transmitting linkage and with the lower assembly being configured to engage a foot of a user, determining an instruction based on the data from the sensor, and controlling an operation of a motor coupled to the force-transmitting linkage based upon the instruction.

DESCRIPTION OF THE DRAWINGS

The drawings described herein constitute part of this specification and includes exemplary embodiments of the present invention which may be embodied in various forms. It is to be understood that in some instances, various aspects of the invention may be shown exaggerated or enlarged to facilitate an understanding of the invention. Therefore, drawings may not be to scale.

FIG. 10 is a table of torque values generated by the AFO and a user.

DETAILED DESCRIPTION

The present system and method employs the use of powered assistance (e.g. ankle assistance) designed to increase or facilitate mobility in a user (e.g. in children or individual with muscle disorders such as CP). Wearable exoskeletons that may be used during daily life may offer a transformative new option for improving mobility by reducing barriers to physical activity, such as for individuals with neurologically-based gait disorders. Challenges to mobility faced by individuals (e.g. individuals with gait deficits from CP) may include prohibitively high metabolic cost of transport, and difficulty completing strength- and balance-intensive weight-bearing tasks such as navigating stairs and around or over obstacles. For improving gait mechanics and walking efficiency, robotic joint (e.g. ankle) actuation can provide positive power to the body through appropriately-timed assistance (e.g. plantar-flexion assistance).

Wearable exoskeletons offer a unique alternative to existing assistance methods e.g. for pediatric gait disorders caused by CP. As one example, an approach suitable for ambulatory children with CP may provide bursts of assistive torque at specific intervals throughout the gait cycle to dynamically improve posture and retrain the neuromuscular system by encouraging volitional muscle activity. This type of powered assistance may seek to maintain and ultimately augment the wearer's range of motion and muscle strength. Furthermore, by offering the potential to drastically reduce the metabolic cost of activity (e.g. walking), powered joint (e.g. ankle) assistance may lead to increases in habitual physical activity.

As a particular example, the ankle joint plays a critical role in whole-body stability and forward propulsion during walking. Dynamic ankle actuation and stability control are required for independent and effective function at home and in the community. Assistance at or near the ankle joint appears to provide significant improvement in walking economy and has the potential to reduce the metabolic cost of transport.

In an embodiment, for improving gait mechanics and walking efficiency, robotic actuation (e.g. ankle actuation) can provide positive power to the body through appropriately-timed assistance (e.g. plantar-flexion assistance) during the walking process. For improving performance during balance-intensive tasks, an exoskeleton (e.g. an ankle exoskeleton) can respond rapidly to perturbations or abrupt changes in posture by modulating joint torque, and therefore joint impedance, in real-time.

An embodiment may apply force to assist a user. This force may be linear force or may be rotational force (i.e. torque). A torque is a specific kind of force, applied around a rotational axis.

Figure 1:
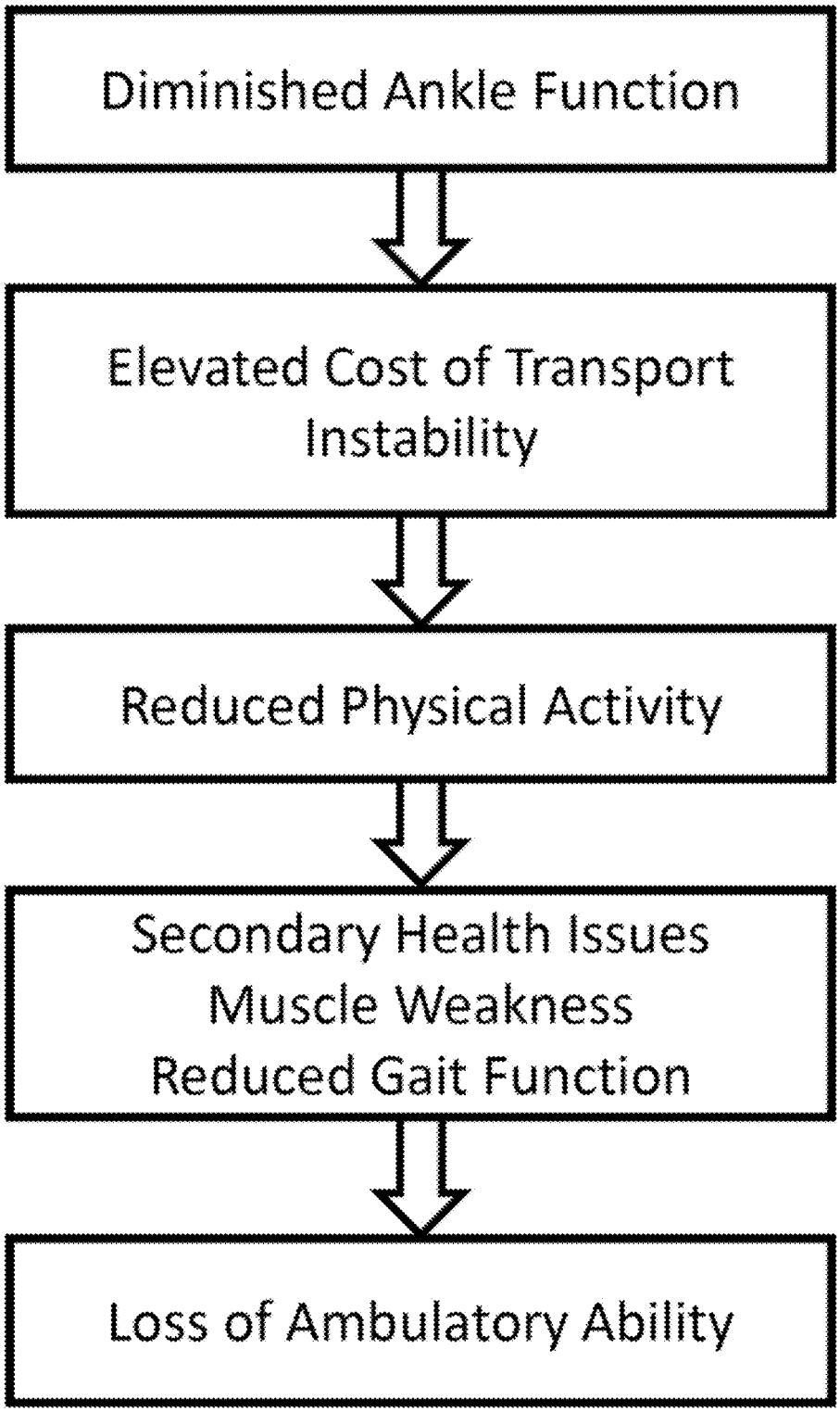
FIG. 1 depicts a diagram of the natural progression of ambulatory decline in individuals with cerebral palsy (CP) that occurs in a large portion of the population.
Figure 2A:
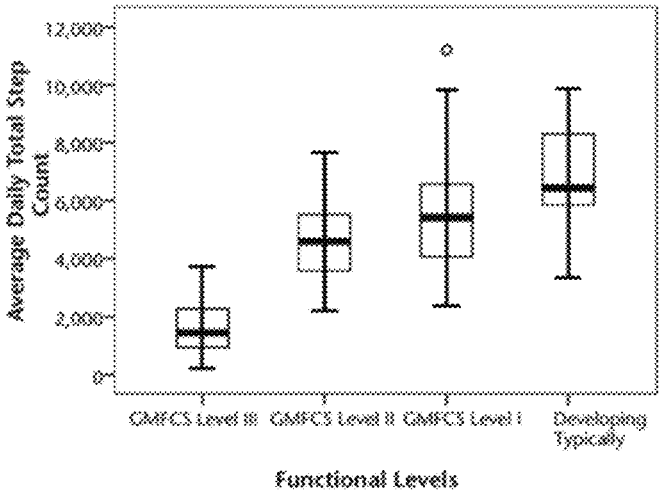
FIG. 2A shows statistically significant differences in daily total step count by CP functional level.
Figure 2B:
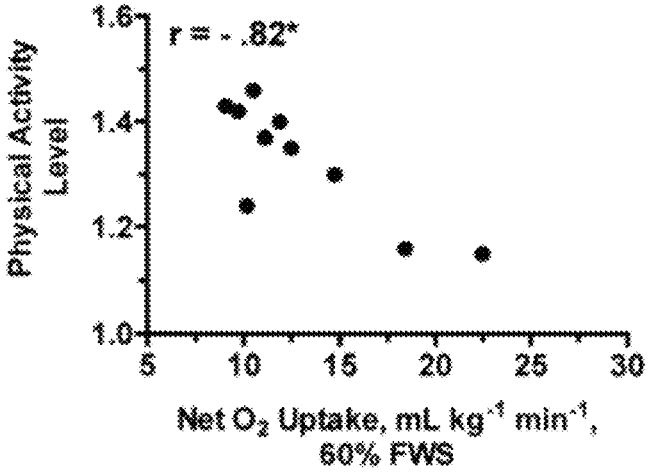
FIG. 2B shows the relationship between the oxygen cost and physical activity level.
Figure 2C:
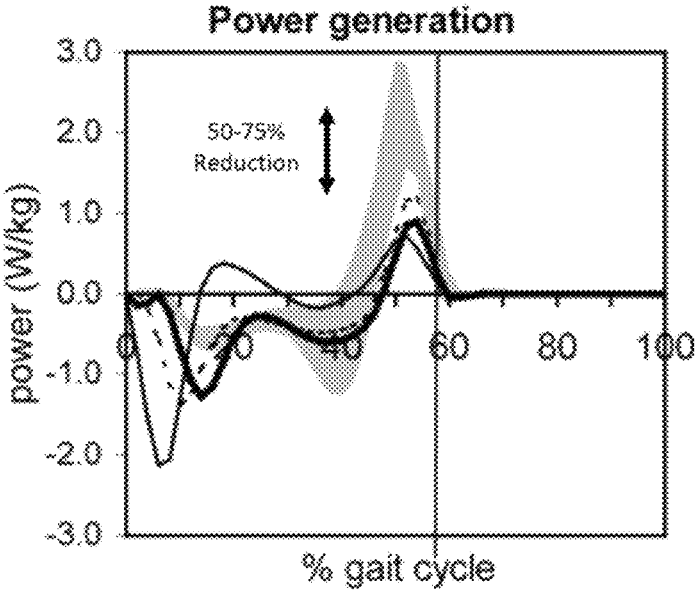
FIG. 2C shows the ankle joint power across gait cycle during barefoot, hinged ankle-foot orthose (h-AFO), and dynamic ankle-foot orthose (d-AFO) walking in a child with CP compared to normal power profile.
Figure 3:
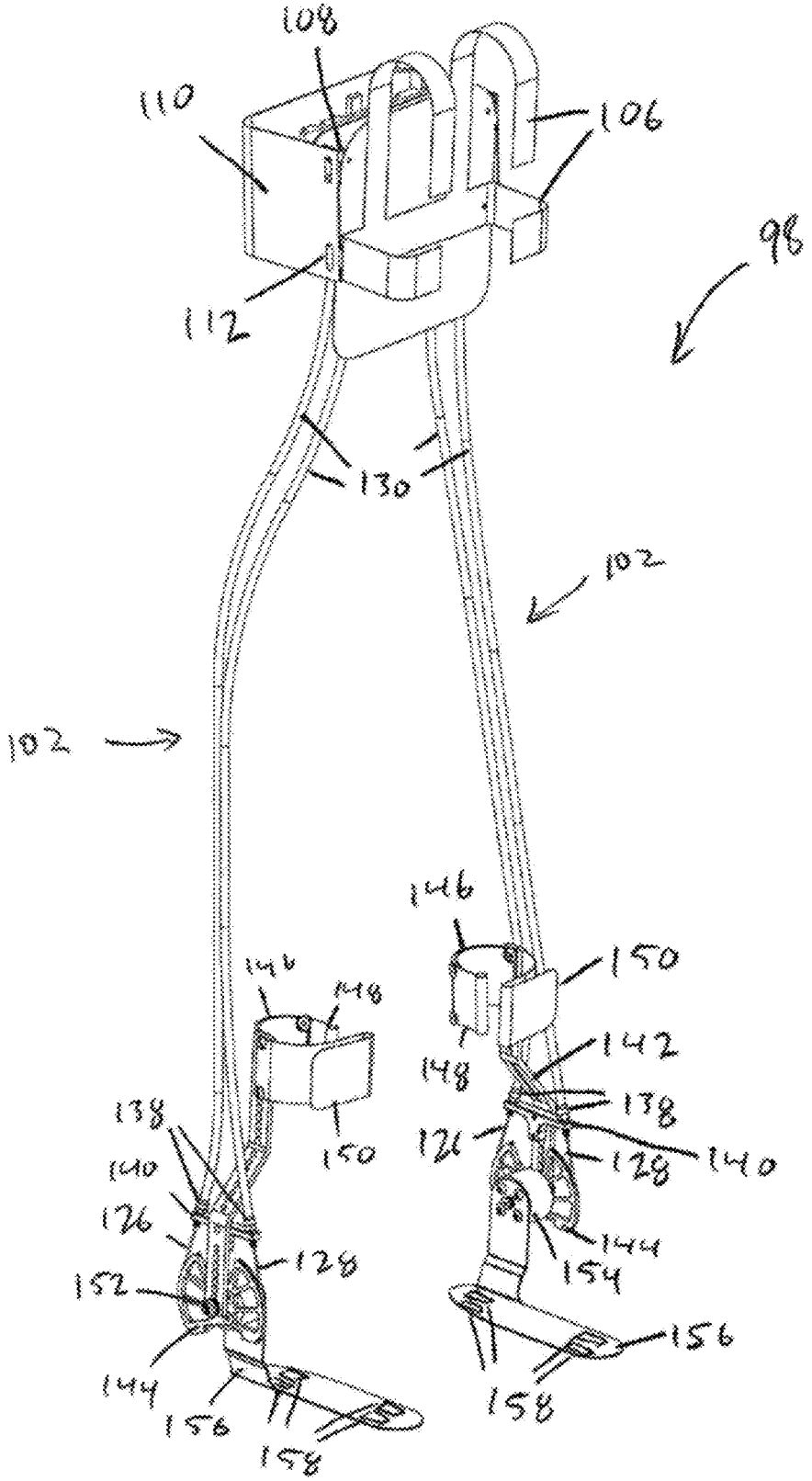
FIG. 3 is schematic of an embodiment of an ankle-foot orthosis (AFO) exoskeleton.
Figure 4:
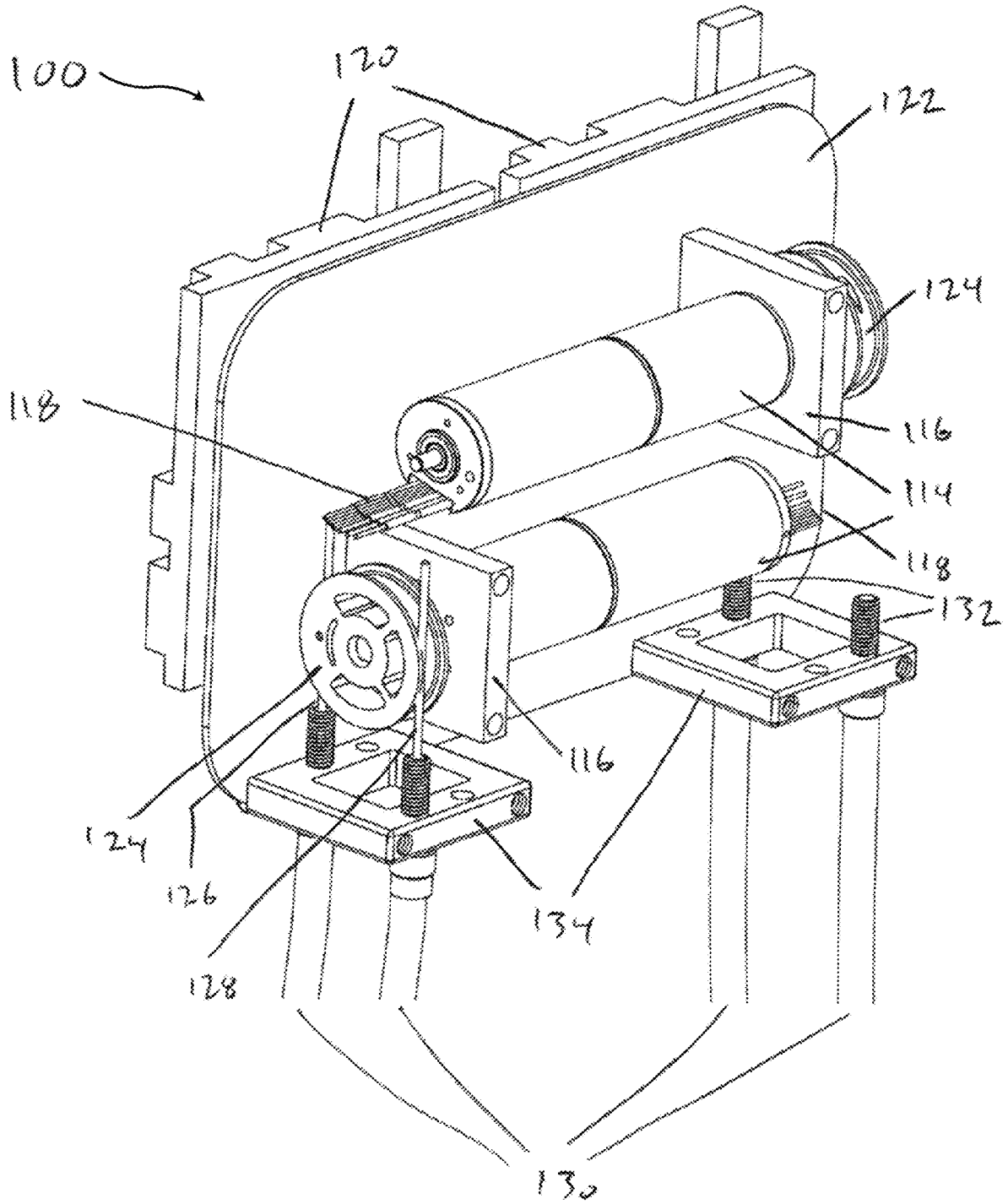
FIG. 4 is a front view of an upper assembly of the AFO.
Figure 5:
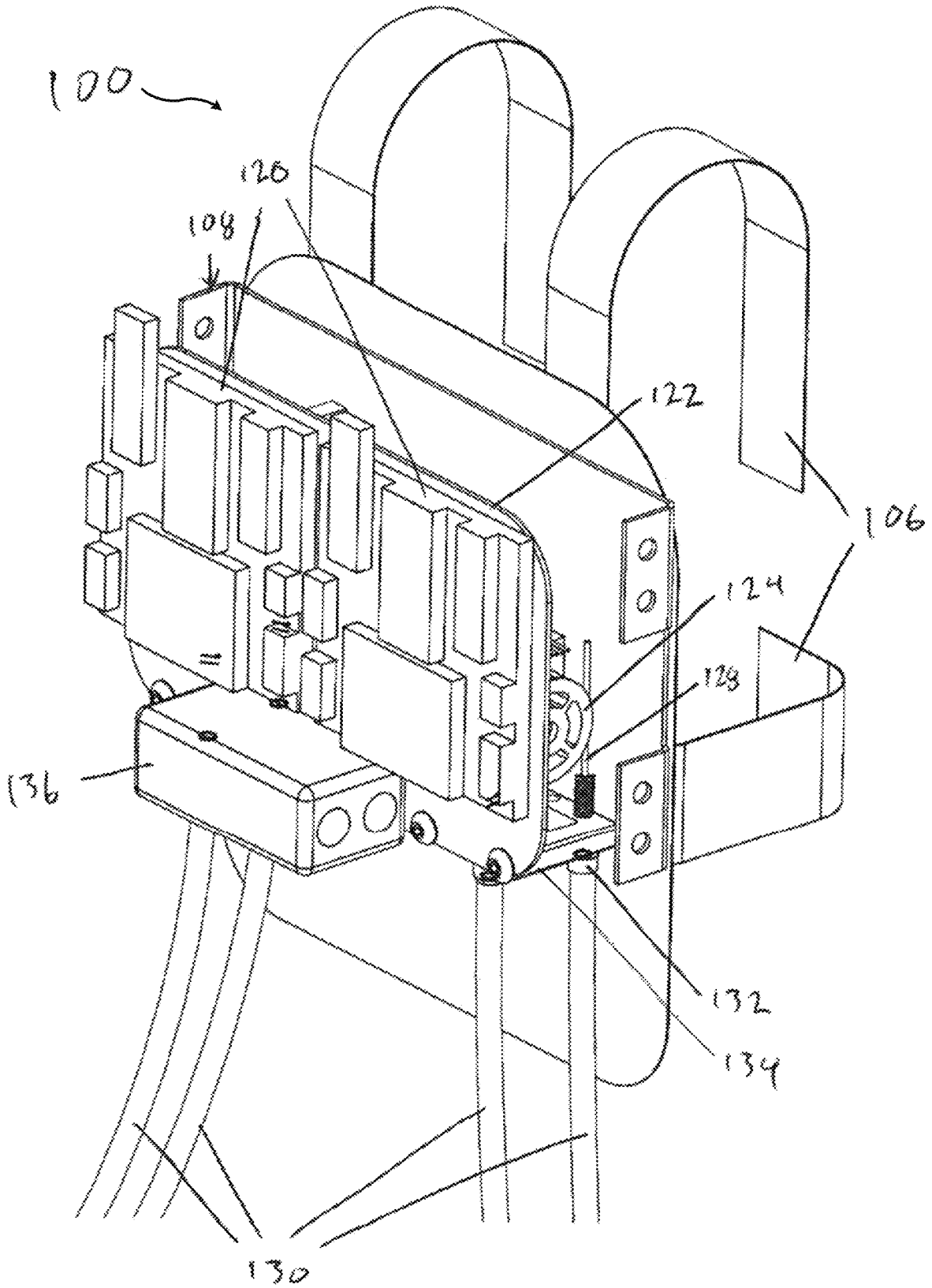
FIG. 5 is a rear view of the upper assembly of the AFO depicted in FIG. 4.
Figure 6:
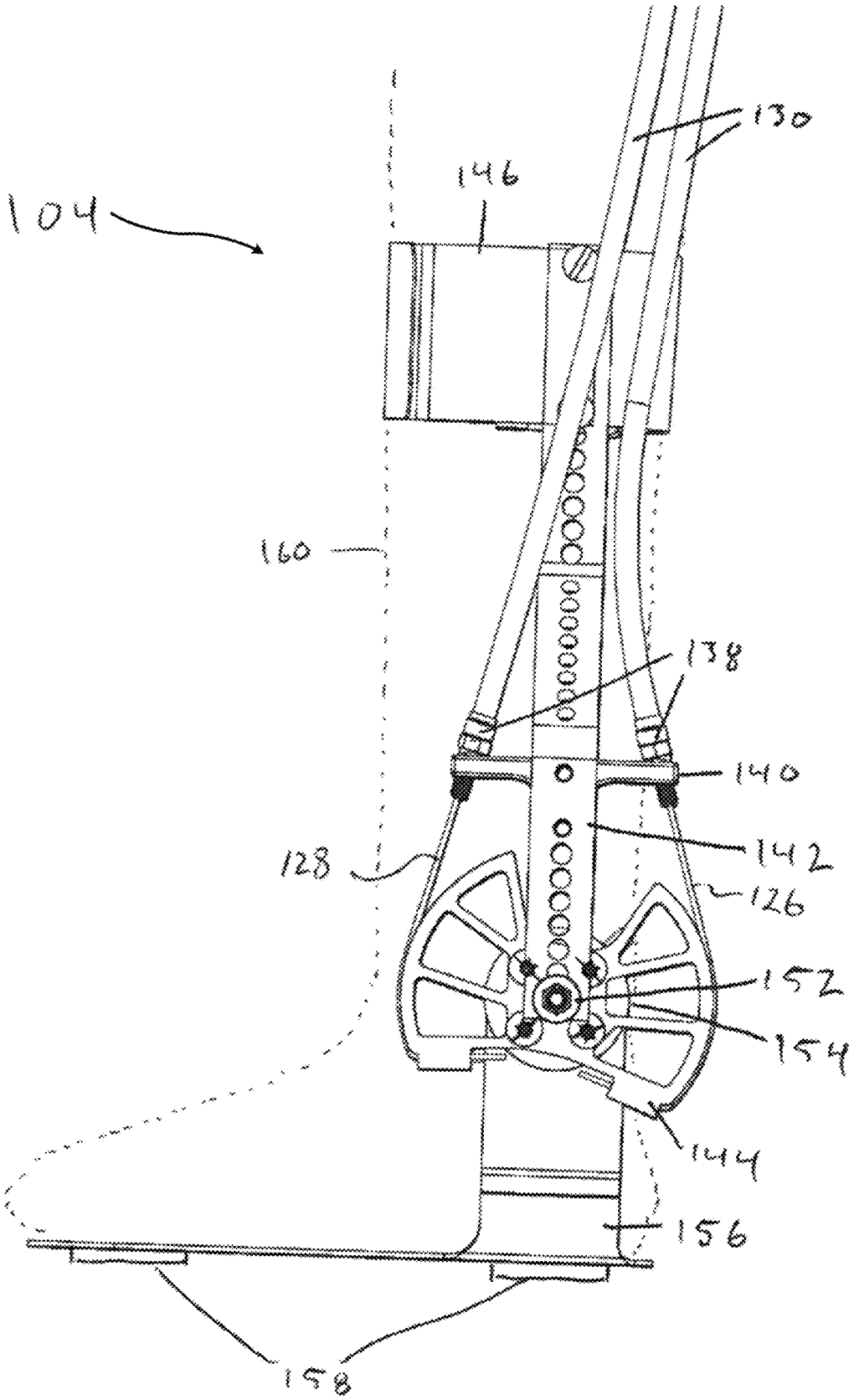
FIG. 6 is a side view of a lower assembly of the AFO.

In an embodiment, the present exoskeleton may provide dynamic "bursts" of assistance, as compared to existing rehabilitation-oriented exoskeletons, which operate by slowly repositioning each limb along desired joint trajectories. Specifically, in the present device motorized assistance may be provided by a powered ankle-foot orthosis (AFO). An embodiment of the present AFO 98 is shown in FIGS. 3-6. Specifically, FIG. 3 depicts a perspective view of AFO 98. FIG. 4 depicts a front perspective view of upper assembly 100 of AFO 98, while FIG. 5 depicts a rear perspective view of upper assembly 100 of AFO 98. FIG. 6 depicts a side view of lower assembly 104 of AFO 98. Taken together, AFO 98 comprises an upper assembly 100, a transmission assembly 102, and a lower assembly 104. Specifically, AFO 98 includes two lower assemblies 104 for a right foot and a left foot of a user. The present description describes the operation of a single lower assembly 104, though it should be understood that a second lower assembly 104 may have a similar configuration and be operated according to the algorithms described herein in association with the user's other foot. The upper assembly 100 comprises attachment straps 106 used to attach the upper assembly 100 to a user (e.g. at a user's waist). The attachment straps 106 may alternately be of a waist strap form, a backpack form, or any other means of supporting weight on the user's waist, torso, or other attachment site.

The attachment straps 106 may be coupled, directly or indirectly, to a motor base plate 108. The motor base plate 108 may provide a rigid surface for mounting or supporting components of the upper assembly 100. The upper assembly 100 may additionally comprise a housing shell 110, which may serve to cover or protect internal components of the upper assembly 100 from direct view or interference. The housing shell 110 may comprise any covering material (e.g. plastic, aluminum, cloth) suitably arranged to cover the upper assembly 100. In an alternate embodiment, the motor base plate 108 and the housing shell 110 may be embodied as a single component, which may comprise a single piece or multiple pieces. The motor base plate 108 may be coupled to the housing shell 110 by means of a plate-to-housing attachment 112. This plate-to-housing attachment 112 may comprise removable fasteners, with examples including bolts, magnets, clips, and slots.

Additional components of the upper assembly 100 are shown in FIG. 4, in a front three-quarter or perspective view. This view is shown without the attachment straps 106, the motor base plate 108, and the housing shell 110, which have been hidden in this figure to reveal underlying components. The upper assembly may comprise one or more force-generating motors 114. This one or more motors may comprise any means to generate force, with examples including rotary electric motors, linear electric motors, hydraulic pistons, pneumatic pistons, and pneumatic bladders.

The one or more motors 114 may be coupled to the motor base plate 108 (see FIG. 3) by means of one or more motor brackets 116. The one or more motor brackets 116 may be comprised of metal, plastic, or any other suitable material for securing the one or more motors 114 to base plate 108. The one or more motor brackets 116 may attach to the motor base plate 108, the one or more motors 114, and to a motor top plate 122, by means of bolts, clips, slots, or other removable or non-removable fasteners.

The motor top plate 122 may provide a rigid surface for mounting or supporting components of the upper assembly 100. The upper assembly may further comprise motor electrical wiring 118, which may be coupled to the one or more motors 114. The motor electrical wiring may be comprised of one or more wires suited for carrying electrical power or electrical control signals to and from the one or more motors 114, with an example embodiment comprising multiple strands of insulated copper wire. The motor electrical wiring may be additionally coupled to one or more circuit boards 120. The one or more circuit boards may comprise one or more printed circuit boards (PCBs), mounting one or more circuits or chips, for performing one or more functions described in following sections.

The one or more circuit boards 120 may be coupled to the motor top plate 122, by means of bolts, clips, slots, or other removable or non-removable fasteners. In an alternate embodiment, the one or more circuit boards 120 may be coupled to one or more other components within the upper assembly 100.

The one or more motors 114 are additionally coupled to one or more motor pulleys 124. In an example embodiment, the one or more motor pulleys may comprise double-wrap side-hole pulleys. In an alternate embodiment, the one or more motor pulleys may comprise any suitable means of transferring force from the one or more motors 114 to one or more transmission elements (e.g. one or more plantarflexion cables 126 and one or more dorsiflexion cables 128). Example alternate embodiments of the one or more motor pulleys 124 include cams, linear shafts, pistons, universal joints, and other force-transferring linkages.

The force generated by the one or more motors 114 is carried by one or more transmission elements. In an example embodiment, the transmission elements include one or more plantarflexion cables 126 and one or more dorsiflexion cables 128. The plantarflexion cables 126 and dorsiflexion cables 128 may be arranged to transfer opposing forces. Such an embodiment may arise due to the suitability of cables for transferring "pulling" forces but not for transferring "pushing" forces. In an alternate embodiment, one or more single transmission elements may be used to transfer opposing (both pushing and pulling) forces. The plantarflexion cables 126 and dorsiflexion cables 128 may be Bowden cables that transfer force via the movement of inner cables relative to a hollow sheath or housing containing the inner cable. The plantarflexion cables 126 and dorsiflexion cables 128 may be comprised of any suitable material, with examples including metal, Kevlar, and nylon.

The one or more plantarflexion cables 126 and one or more dorsiflexion cables 128 may each be housed in a cable sheath 130. The one or more cable sheaths 130 may serve to support and house the plantarflexion cables 126 and dorsiflexion cables 128. The one or more cable sheaths may each be additionally coupled to barrel adjustors 132. The barrel adjustors 132 may provide means for fine adjustment of the length of the sheaths 130, and thereby provide means for adjustment of the baseline tension of the plantarflexion cables 126 or dorsiflexion cables 128, as well as adjustments of the plantarflexion cables 126 and dorsiflexion cables 128 for purposes of fitting or adjusting AFO 98 to different users. The one or more barrel adjustors may be further coupled to one or more cable brackets 134, for purposes of support. The one or more cable brackets 134 may be further coupled to one or more of the motor top plate 122, the motor base plate 108, or any other rigid element of the upper assembly 100.

The upper assembly 100 is shown in FIG. 5 in a rear three-quarter view. This view is shown without the housing shell 110, to reveal underlying components. The upper assembly 100 may additionally comprise one or more batteries 136. The one or more batteries may be coupled to the motor top plate 122, or to the circuit board 120, or to any rigid component of the upper assembly 100, by removable or non-removable attachments (e.g. brackets or bolts). The one or more batteries 136 may comprise any suitable means for storing and delivering electrical power, with examples including nickel cadmium, nickel metal hydride, lithium ion, lead acid, alkaline, and lithium batteries. The one or more batteries 136 may be rechargeable or single use. The upper unit 100 may further comprise circuitry and components for connecting and rectifying external electrical power received from external sources to provide means for charging of a rechargeable embodiment of the one or more batteries 136.

Returning to FIG. 3, the one or more plantarflexion cables 126, dorsiflexion cables 128, and cable sheaths 130 may be routed down one or more legs of a user to reach the lower assembly 104. This collection of cables and sheathings comprises a transmission assembly 102. The transmission assembly 102 may alternately be any means of transferring force from the upper assembly 100 to the lower assembly 104. In a preferred embodiment, the transmission assembly 102 is substantially lightweight and substantially flexible so as to allow minimal impediment of motion of the knee and hip joints of a user. The AFO 98 may include one or more lubricating fluids or materials, disposed on an element or between two relatively-moving elements to reduce friction and increase efficiency. Example locations of lubrication may include: inside bearings 152; inside motors 114; and between cables (e.g. plantarflexion cable 126 or dorsiflexion cable 128) and their respective sheaths 130.

The lower assembly 104 of AFO 98 is shown in FIG. 6 in a side view. The lower assembly 104 may configured to attach to a foot 160. It will be apparent to a person of ordinary skill in the art that two lower assemblies 104 may be used to couple to each foot of a user of AFO 98. The cable sheaths 130 of the transmission assembly 102 may be coupled to the lower assembly 104 by lower barrel adjusters 138. The lower barrel adjustors 138 may provide means for fine adjustment of the length of the sheaths 130, and thereby provide means for adjustment of the baseline tension of the plantarflexion cables 126 or dorsiflexion cables 128 housed within the sheaths 130 and also adjusting the plantarflexion cables 126 and dorsiflexion cables 128 to fit the wearer of lower assembly 104. The one or more barrel adjustors 138 may be mounted on a support block 140. The one or more support blocks 140 may each be additionally coupled to an upright 142. The one or more uprights 142 may serve as a mounting or support element for the components of the lower assembly 104.

After passing through the barrel adjusters 138 and exiting their sheaths 130, the one or more plantarflexion cables 126 and one or more dorsiflexion cables 128 may couple to one or more sprockets 144. The sprocket 144 may clamp to each of an opposing pair of one plantarflexion cables 126 and one dorsiflexion cables 128, wherein an opposing pair may comprise two cables coupled to a single motor pulley 124 in the upper assembly 100. In an alternate embodiment, an opposing pair may instead embodied in a single element with the capability to transfer both positive and negative forces. In an alternate embodiment, the sprocket 144 may comprise any means for capturing force from a transmission assembly 102 to produce torque between two or more attachment points with at least one attachment point on each of the distal side and the proximal side of the user's ankle joint (e.g., torque between the insole bracket 156 and the orthotic cuff 146).

Each upright 142 may be additionally coupled to an orthotic cuff 146, which is most readily visible in FIG. 3. The orthotic cuff 146 may be additionally coupled to a D-ring strap 148 and a Velcro strap 150. The orthotic cuff 146, D-ring strap 148, and Velcro strap 150 may be considered together as an attachment mechanism for coupling the lower assembly 104 to a leg of a user at an attachment site which may be proximal to the ankle and distal to the knee of the leg of the user.

Each upright 142 may be additionally coupled to a bearing or joint 152. The one or more bearings 152 may each be additionally coupled to a sprocket 144. Each of the one or more bearings 152 may serve as a freely-rotating and load-bearing connection between an upright 142 and a sprocket 144. Each collection of an upright 142, a sprocket 144, and a bearing 152 may be coupled by means of bolts and nuts or other suitable connecting hardware.

The one or more sprockets 144 may each be additionally coupled to a torque sensor 154. The one or more torque sensors 154 may be used to sense the torque force applied by the exosketon to the user's ankle joint. Each torque sensor 154 may be additionally coupled to an insole bracket 156. The one or more insole brackets 156 provide means for torque to be applied to a walking surface. The one or more insole brackets 156 may be comprised of plastic, metal, or any suitable rigid material. The one or more insole brackets 156 may be configured to be inserted into a user's footwear, by means of using thin elements without external straps.

Each upright 142 and insole bracket 156, taken in combination, may be considered as a force-applying arm forming a joint, where the two force-applying arms apply torque around an axis, where the axis is aligned with a body joint axis (e.g. an ankle joint axis). When a force is applied along a length of plantarflexion cables 126 or dorsiflexion cables 128, that force is applied to sprocket 144 and, in turn, insole bracket 156. Accordingly, the forces applied along the lengths of plantarflexion cables 126 and dorsiflexion cables 128 apply a force causing insole bracket 156 to rotate about bearing 152 with respect to upright 142.

In an alternate embodiment, the one or more sprockets 144 may be coupled directly to the corresponding one or more insole brackets 156 without an intermediate torque sensor 154.

In an embodiment, one or more accelerometers may be coupled the lower assembly 104 to provide information on the user's gait.

The AFO 98 may be additionally coupled to one or more pressure sensors 158. The one or more pressure sensors 158 may be comprised of force-sensitive resistors, piezoresistors, piezoelectrics, capacitive pressure sensors, optical pressure sensors, resonant pressure sensors, or other means of sensing pressure, force, or motion. The one or more pressure sensors 158 may be arranged across the bottom area of the insole bracket 156 to provide spatial pressure information across the foot surface.

Referring back to FIG. 5, the one or more circuit boards 120 of AFO 98 may comprise one or more of each of the following components or controllers: microprocessor circuitry (e.g. an ARM-based microprocessor), power management circuitry, signal processing circuitry, and motor driver circuitry. Each motor driver circuitry may be additionally coupled to one or more motor wirings 118. Each power management circuitry may be additionally coupled to one or more batteries 136. Each signal processing circuitry may be additionally coupled to one or more of: torque sensors 154 and pressure sensors 158, and any other sensors, such as accelerometers mounted on or coupled to components of AFO 98.

In an embodiment, a controller circuitry coupled to the one or more circuit boards 120 may operate a finite state machine to control the operation of AFO 98 and, specifically, motors 114 to provide assistance to a wearer for AFO 98. Specifically, the state machine implemented by the controller may define a number of different states, including early stance, late stance, and swing phases of the user's gait or step cycle that, in turn, control which of motors 114 is operated to apply force to either plantarflexion cables 126 or dorsiflexion cables 128 to provide force assistance at the ankle of the wearer. Specifically, with reference to FIG. 6, when a pulling force is applied to plantarflexion cables 126 by motors 114, a torque force is applied to sprocket 144 causing insole bracket 156 to be rotated downwards with respect to upright 142 thereby assisting the using in moving their toes downwards (i.e., plantarflexion). Conversely, when a pulling force is applied to dorsiflexion cables 128 by motors 114, a torque force is applied to sprocket 144 causing insole bracket 156 to be rotated upwards with respect to upright 142 thereby assisting the using in moving their toes upwards (i.e., dorsiflexion). In this manner, upright 142 and insole bracket 156 operate as first and second arms of a hinged connection at the user's ankle. The first arm of the hinge (e.g., upright 142) is fixed to the user's ankle (e.g. by orthotic cuff 146 around the lower leg), while the second arm of the hinge (e.g., insole bracket 156) is positioned along a user's foot.

The state machine may receive input from one or more sensors (e.g. 154, 158), and use current and previous input values in order to determine a current state of the state machine. The current state is then used to determine the timing of the motor 114 activation, in order to provide torque assistance to the user with appropriate timing and intensity (e.g., to provide plantarflexion assistance during toe-off, or dorsiflexion assistance during foot swing to prevent drop foot).

Figure 7A:
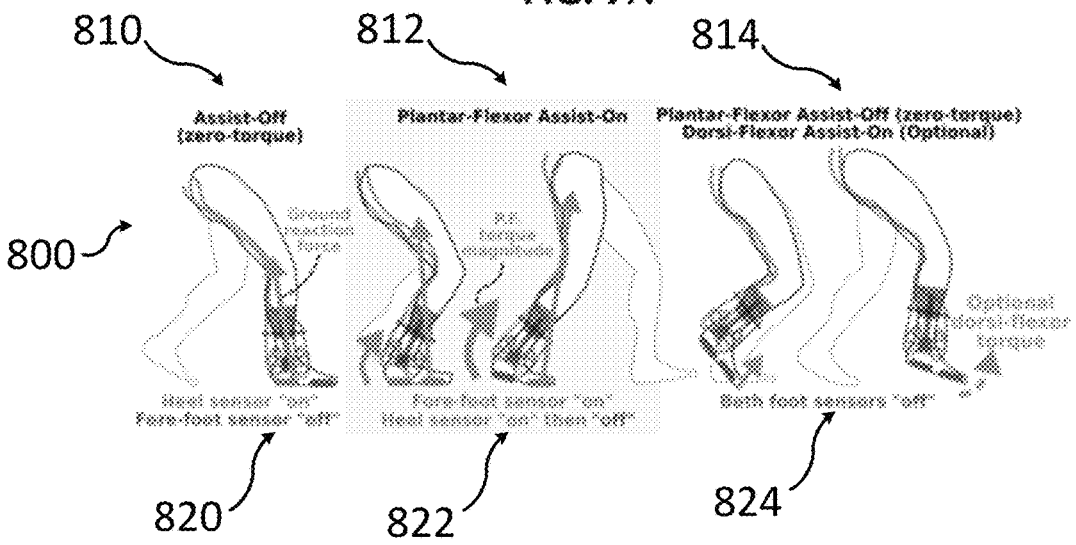
FIG. 7A depicts aspects in a gait cycle of an individual, with corresponding sensor readings.
Figure 7B:
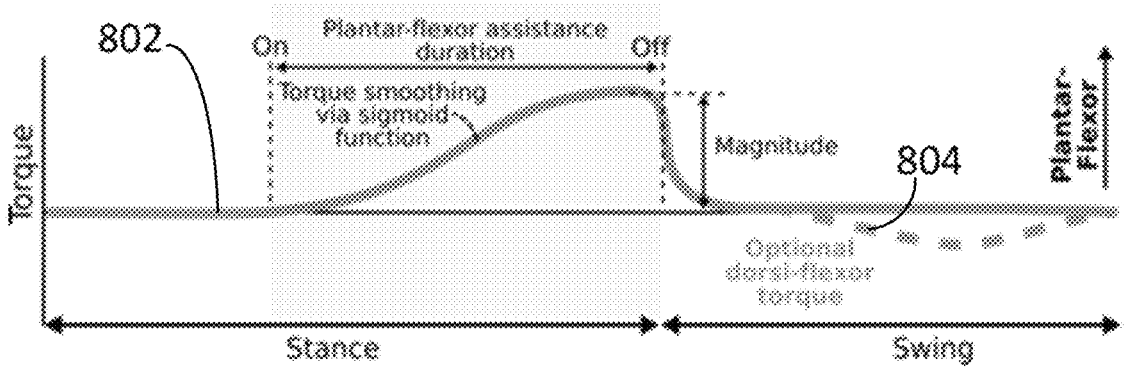
FIG. 7B depicts desired torque output, corresponding to the gait cycle of FIG. 7A.

To illustrate the stages of the state machine implemented by the controller of AFO 98, FIGS. 7A and 7B depict aspects of a gait cycle, the corresponding sensor 158 signals, and the corresponding output forces.

Specifically, FIG. 7A shows a diagram 800 of a foot and AFO 98 position through a gait cycle (top), along with corresponding readings from sensors (bottom). In this example, the AFO 98 uses two pressure sensors 158 on a foot: one proximal to the heel and one proximal to the fore-foot (e.g. under the ball of the foot). The readings from the sensors determine the state of the state machine. FIG. 7A depicts example gait cycle states 810, 812, and 814, which correspond to different states in the state machine of the controller of AFO 98. Sensor readings 820, 822, and 824 show the readings from the sensors 158. These readings 820, 822, 824 each instruct the state machine to transition to a corresponding state. These states may correspond to gait phases such as "heel strike", "toe off" and "swing". For each state, the state machine has output values. The state machine output at least partially determines the instructions to be delivered to the motor. FIG. 7B shows an example of assistance output relative to gait cycle, wherein the assistance output 802 is "on" (e.g. the assistive torque is non-zero) during the times when the user's forefoot is applying pressure to the ground and assistive torque may be desired.

In an example embodiment, signals generated by a torque sensor 154 mounted proximate the wearer's ankle may be used as input to a control algorithm (e.g. proportional-integral-derivative (PID) control) executed by the controller of the one or more circuit boards 120. The control algorithm may be used to ensure that the actual torque produced at the ankle is substantially equivalent to the specified (i.e., desired) torque required while the wearer of AFO 98 walks.

Figure 7C:
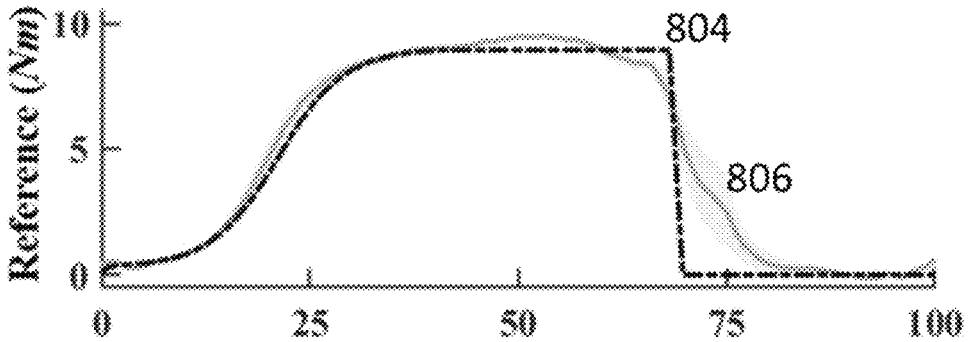
FIG. 7C depicts feedback control of torque output.

FIG. 7C shows an example of a desired torque profile over time (dashed line 804) and a measured torque profile (gray line 806). Feedback through a control algorithm may be used by one or more motor driver circuits to control one or more motors 114.

As the user's foot proceeds through the gait cycle depicted in FIG. 7A, the pressure measurements captured by pressure sensors 158 will vary. Specifically, in an initial state at the beginning of the gait cycle (e.g., gait cycle state 810) when the user's toe first contacts a ground surface, the pressure measured by a fore-foot pressure sensor 158 may begin transitioning from a low or minimal value to a relatively high or maximum value. After the user steps upon the ground 810, the user begins transitioning through gait cycle state 812 as the measured fore-foot pressure value gradually increases until it reaches a maximum. At the gait cycle state 814, the user's foot leaves the ground and the gait cycle enters the swing phase. During the gait cycle, the controller monitors the measured torque value and compares the measured torque value to the desired torque value to determine the instructions to be delivered to the motors 114.

The controller may continue to operate in the on state (i.e., providing assistance) until the measurements of fore-foot and/or heel pressure sensors 158 fall below a threshold value. At that time, the controller may determine that the gait cycle has entered a state in which the user's foot has left the ground (e.g., state 814) and the controller can transition, as illustrated in FIG. 7B to an off state.

While in the on state, the controller operates motors 114 to provide physical assistance to the user of AFO 98. Specifically, the controller transmits control instructions to motors 114 to rotate in a direction causing motors 114 to apply a pulling force against plantarflexion cables 126. This action causes a rotation force to be applied to insole bracket 156 in the same direction as the torque being applied by the user. Accordingly, the controller operates motors 114 to provide an assistive force that compliments that already being provided by the user.

During the on state, the forces applied by motors 114 are controlled based upon instructions provided to the motors 114 by the controller. In an embodiment, the controller controls the force applied by motors 114 based upon the torque measurements gathered by torque sensors 154. For example, during the on state, the controller may cause the motors 114 to apply a rotational force to insole bracket that is a sufficient to achieve a specific value of the torque measured by torque sensor 154. A target torque value may be determined for each state in the gait cycle. The controller may then be configured to provide torque through the operation of motors 114 that causes the applied torque measured by torque sensor 154 and provided by the operation of motors 114 to reach to desired torque value (e.g. by a proportional-integral-derivative (PID) control scheme). Different desired torque values may be defined for each states in the gait cycle.

During the off state, controller may be configured to be inactive by not operating motors 114, thereby enabling free movement of insole bracket 156. In some embodiments, however, the controller may be configured to, during the off state, operate motors 114 in a reverse direction (causing a pulling force to be applied to dorsiflexion cables 128) to assist the user in raising the toes of the foot while the gait cycle is in the swing phase (e.g., state 814 of FIG. 7A).

Alternate embodiments may use other sensing modalities (e.g. accelerometers, torque sensors) to determine the gait cycle state (e.g. 810, 812, 814) and thereby determine the timing of the AFO 98 assistive output.

As shown in FIG. 7A, a state machine may operate by first comparing each sensor reading (e.g. heel pressure and fore-foot pressure, from pressure sensors 158) to a threshold. If a reading is above a threshold, the state machine may interpret the reading as a value of "on"; if the reading is below the threshold, the state machine may interpret the reading as a value of "off". Then, if a heel pressure input is "on" and a fore-foot pressure input is "off", the state machine may instruct the controller to set the desired torque output to zero. Then, if the fore-foot pressure input switches to "on", then the state machine may instruct the controller to set the desired torque output to be a non-zero plantarflexion torque assistance output. This torque output may increase over time (as in FIG. 7B). Then, if the fore-foot pressure reading switches to "off", the state machine may instruct the state machine may instruct the controller to set the desired torque output to zero, or may instruct the controller to set the desired torque output to be a non-zero dorsiflexion torque assistance output.

Figure 9:
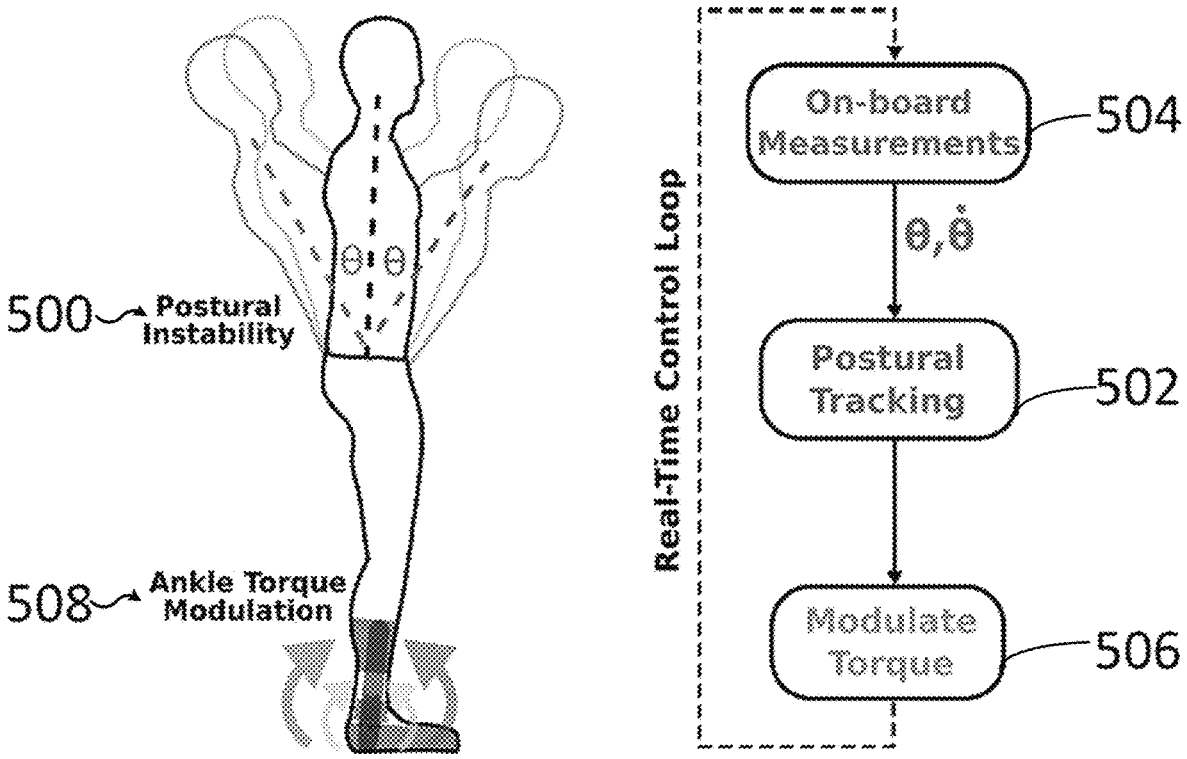
FIG. 9 is a schematic depicting the operation of a balance-assisting exoskeleton (left) and a real-time control framework (right).

An example embodiment may additionally be configured to perform standing assistance. As shown in FIG. 9, standing assistance may be performed by using sensors 504 (e.g. accelerometers, inertial measurement units) to determine the user's balance 500 and posture 502, processing the sensor signals according to control algorithms on the circuit boards 120 to determine a desired torque 506, and controlling the motors 114 to apply torque 508 to the ankle to configured to assist a user in maintaining balance 500.

For example, based upon sensor data (e.g. captured from torque sensor 154 pressure sensors 158, accelerometers, inertial measurement units), the controller may determine that the user of AFO 98 is not walking and is instead standing still. If the user is standing still, the operation of the controller may be modified. Instead of providing an assistive force (as in the mode of operation described above in conjunction with FIGS. 7A-7C), the controller may provide an opposing force to that being measured an accelerometer sensor. Specifically, as the user is standing still, the controller may operate motors 114 in an attempt to stabilize an accelerometer reading, thereby assisting the user to stand still in an upright position.

Accordingly, if an accelerometer sensor measures an excessive leaning angle in a first direction, the controller may operate motors 114 to pull on one of plantarflexion cable 126 or dorsiflexion cable 128 so that an opposing torque force is generated, thereby returning the leaning angle to below excessive values. Such operation may assist the user in standing upright with relatively little ankle motion.

In an example embodiment, an exoskeleton may be customized for each individual user. Customization may include adjusting the size or shape of one or more components to fit a user. Example adjustments include settings for: the length of the one or more dorsiflexion cables 128, plantarflexion cables 126, and their respective sheaths 130; the size and shape of the one or more insole brackets 156; the length and shape of the one or more uprights 142, the size and shape of the one or more orthotic cuffs 146, and the length and arrangement of the attachment straps 106.

Figure 11A:
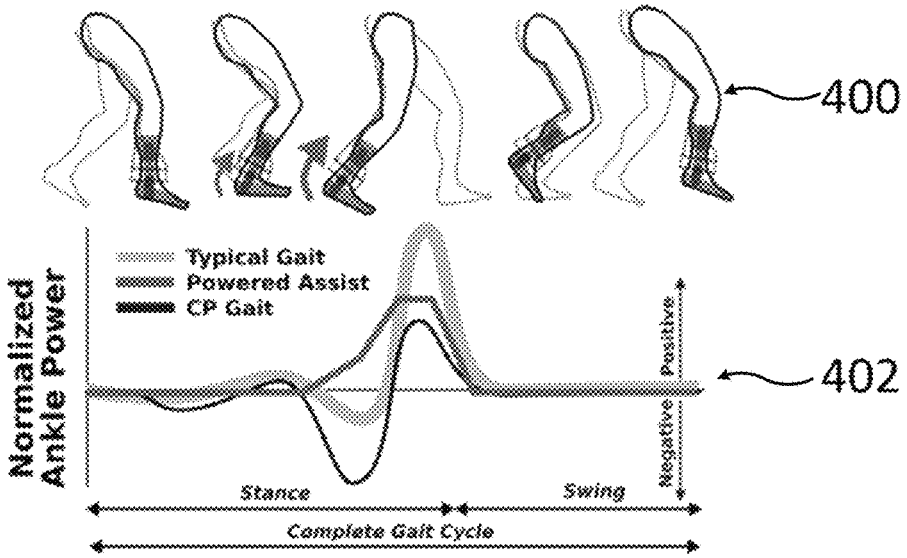
FIG. 11A depicts schematics of a timing of a powered ankle plantar-flexor assistance during walking.
Figure 11B:
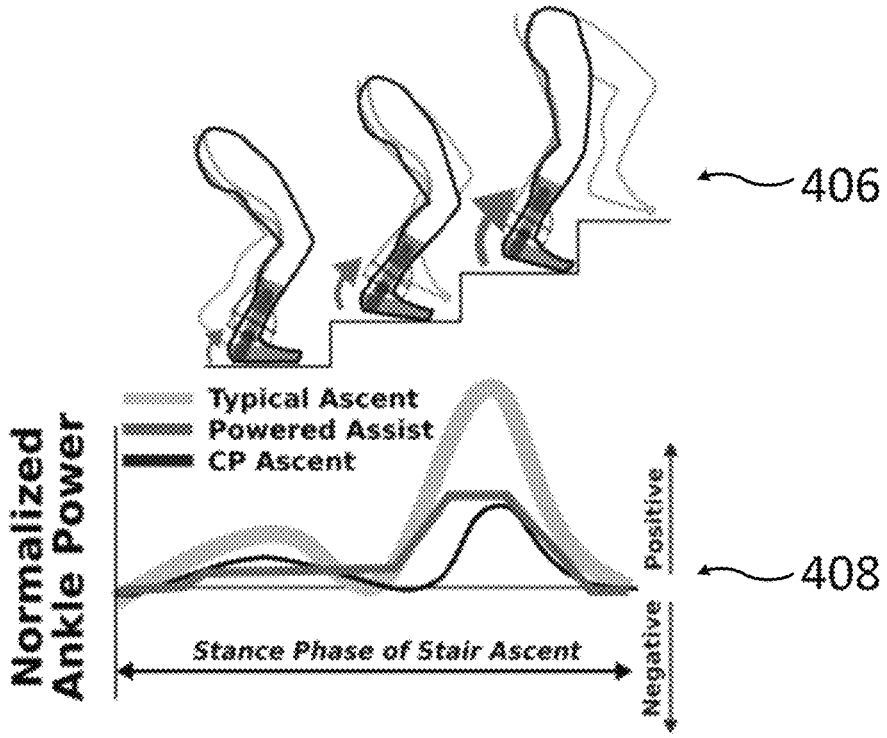
FIG. 11B depicts schematics of a timing of a powered ankle plantar-flexor assistance during stair ascent.

In an embodiment, the amount of assistance provided to a user's ankle joints may be further customized based on restoring positive power to normal levels. Table 1300 shown in FIG. 10 shows an example of the amounts of torque and power produced by the user's ankle, by the AFO exoskeleton, and by the combined user+AFO 98. In an example, the torque and power produced by the combined user+AFO 98 may be substantially equivalent to a target torque and power. The target torque and power may be designed to be equivalent to that of an individual having a typical (non-CP) gait and having age and/or body mass substantially equivalent to that of the AFO 98 user. This embodiment is further shown in FIG. 11A with diagrams showing leg position 400 and ankle power 402 during walking, and in FIG. 11B with diagrams showing leg position 404 and ankle power 406 during stair climbing.

The preceding example embodiments do not distinguish between "left" and "right" components of the exoskeleton. In an example embodiment, as depicted in FIG. 3, there may be a symmetrical arrangement of all components in the transmission assembly and lower assembly such that the AFO may assist both the left leg and the right leg of the user. The upper assembly need not be symmetric in this embodiment, except insofar as it is coupled to the transmission assembly.

In an example embodiment, the components having greatest mass (e.g. motors 114, batteries 136) may be placed near to the user's center of mass (e.g. hips or torso). In such an example embodiment, the transmission assembly 102 may serve to deliver torque to the lower assembly 104 without placing undue weight on the distal elements of the user's legs. Such an embodiment may serve to maximize walking economy, by minimizing the metabolic cost due to the mass added to the body.

In an example embodiment, the AFO 98 may be configured such that the transmission assembly 102 is capable of at least partially supporting or offloading the weight of the upper assembly 100, thereby transferring the weight of the upper assembly directly to the lower assembly 104. This supporting or offloading function may be modulated by the gait cycle of the user. As an example, a Bowden cable transmission assembly may be aligned or otherwise configured such elements that the transmission assembly 102 may push upwards on the upper assembly 100 when the corresponding limb is on the ground, and elements of the transmission assembly 102 may remain flexible when the corresponding limb is in motion. In this manner, the offloading may reciprocate between two limbs as the limbs each transition between stance phase and swing phase. An ability of a transmission assembly 102 to at least partially support an upper assembly 100 may reduce the overall metabolic burden on a user.

An alternate embodiment may comprise one or more chain components attached to one or more ends of one or more plantarflexion cables 126 or dorsiflexion cables 128. The one or more chain may be additionally coupled to at least one of a sprocket 144 or a motor pulley 124. Such a chain may serve as a flexible force-transferring linkage connecting a sprocket 144 or pulley 124 to a plantarflexion cable 126 or dorsiflexion cable 128, and thereby would allow actuation of the cable (126 or 128) without requiring the cable to bend around the radius of the sprocket 144 or motor pulley 124.

An embodiment may additionally comprise modular attachment points, which may be coupled to one or more insole brackets 156, sprockets 144, or torque sensors 154, and which may be configured to mount to multiple various platforms (e.g. an individual's shoes, a custom molded orthotic insert made from thermo-plastic).

An embodiment may be suited particularly for individuals with CP who drag their toes excessively (e.g. due to prior usage of a passive AFO 98 preventing plantar-flexion). Such an embodiment may be configured to apply force for dorsiflexor assistance during the swing phase of the user's gait.

Figure 8:
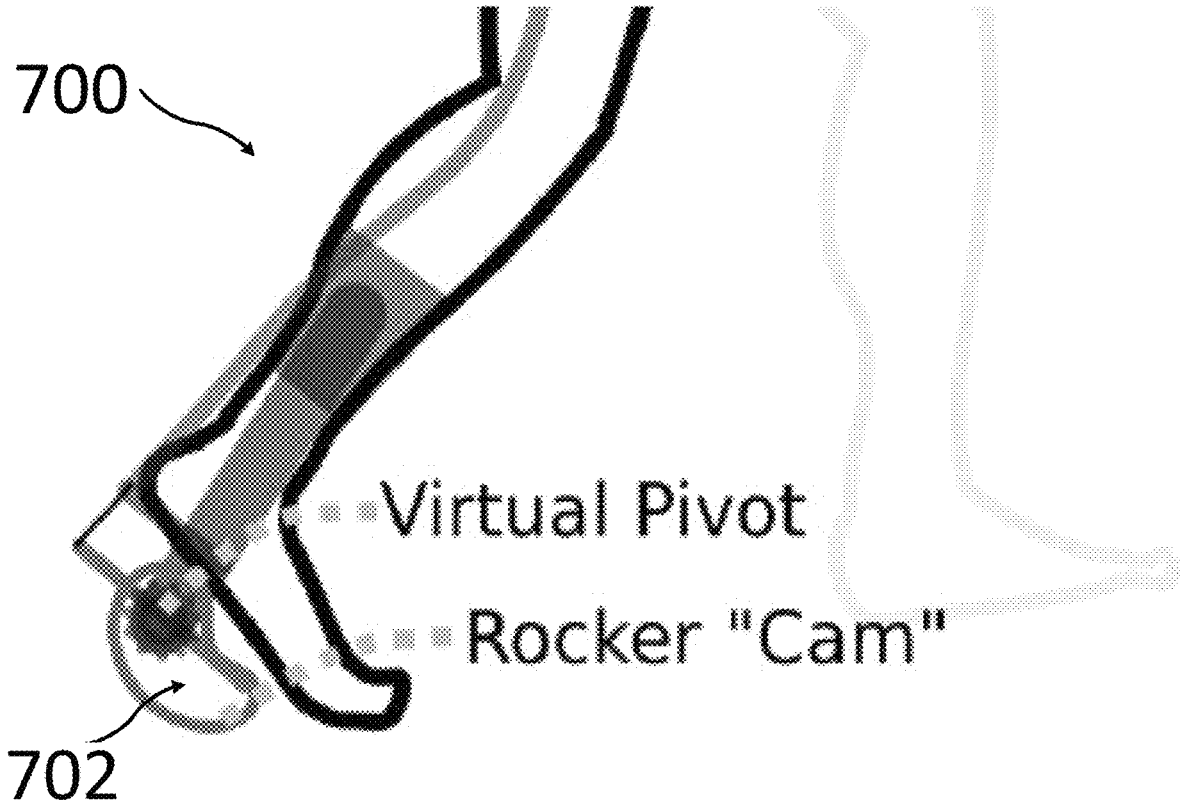
FIG. 8 is a schematic of the exoskeleton control design to address equinus deformity resulting in "tip-toe" gait.

An embodiment may be used to assist individuals having an equinus posture. In such an embodiment, an exoskeleton attachment may be used to provide a "virtual ankle" actuation 700 in series with the biological ankle joint. Such an embodiment may incorporate a cam mechanism 702 configured to rotate under a raised heel to provide positive power (FIG. 8).

An embodiment may facilitate lasting motor adaptation via plasticity of the neuromuscular system. Short-term motor adaptation may be prolonged via repetitive training and reinforcement e.g. in individuals with neurological deficits; extended periods of motor training with external assistance may guide the establishment of new, more permanent motor patterns. This embodiment may be used to provide lasting rehabilitation outcomes, e.g. in children with CP. Such an embodiment may entail repeated use of the AFO 98 over a period of weeks or months, with such a repeated use occurring the context of rehabilitation or of everyday activity. Such an embodiment may further entail adjustments of the AFO 98 output in order to facilitate lasting motor adaptation (e.g. lowering the AFO 98 output over time).

An embodiment may be additionally used to provide exercise or training to a user. In such an embodiment, the motor 114 control may be configured to apply resistance to one or more joints of the user during motion. An embodiment may be configured to sense motion of a user and apply torque to partially counteract the torque generated by the user. An embodiment may additionally comprise an "exercise switch", allowing a user or other individual to switch between "exercise" and "assistance" settings, wherein the exercise mode AFO 98 is turned off and does not provide force assistance to the wearer. An embodiment may additionally comprise an interface, communicably connected to the one or more circuit boards 120, allowing a user or other individual to set or program desired forces (e.g. motor 114 outputs or torque sensor 154 readings) for assistance or exercise.

An embodiment may additionally comprise a communication system, electrically connected to a circuit board 120 of an AFO 98. Such a communication system may be configured to transmit and/or receive information. Information that may be transmitted includes: user walking time, sensor reading logs, performance metrics, and other information generated or sensed by the AFO 98. Information that may be received includes: control software updates, training exercise settings, assistance settings, and other information that may modify the function of the AFO 98. Such a communication system may allow for individualized training and control of an AFO 98, specific for each user. Such a communication system may communicate to a remote server "cloud", or may communicate by other internet-based means, or may communicate to local devices.

An embodiment may additionally comprise one or more "disengage switches" allowing a user or other individual to disconnect one or more force-transferring connections of an exoskeleton. An example of this embodiment may comprise a removable force-transferring connection (e.g. a removable pin or a switchable clamp) connecting a sprocket 144 to a torque sensor 154 and insole bracket 156, or any other connection between two rotating parts that may be toggled such that the rotating parts are linked or unlinked. In an embodiment, disengaging a force-transferring connection (e.g. removing a pin or loosening a clamp) may allow the insole bracket 156 and the sprocket 144 to rotate independently. Disengaging a force-transferring connection in an embodiment may allow a user to walk, sit, or perform any other activity without assistance or interference from AFO 98.

The described features, advantages, and characteristics may be combined in any suitable manner in one or more embodiments. One skilled in the relevant art will recognize that the circuit may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus appearances of the phrase "in one embodiment," "in an embodiment," and similar language throughout this specification may, but do not necessarily, all refer to the same embodiment.

I claim:

1. A device, comprising:

a motor;

a force-transmitting linkage, mechanically coupled to the motor, wherein the force transmitting linkage comprises a first cable and a second cable coupled to the motor such that the motor applies tension to the first cable when rotating in a first direction and applies tension to the second cable when rotating in a second direction;

a lower assembly including a joint mechanically coupled to the first and second cables, such that the joint experiences torque in a first direction upon application of tension to the first cable and experiences torque in a second direction upon application of tension to the second cable, the lower assembly being configured to engage a foot of a user;

a controller, communicably coupled to the motor, wherein the controller is configured to transmit an instruction to the motor; and a sensor coupled to the lower assembly and communicably coupled to the controller, wherein the sensor is configured to detect motion or force of the joint;

wherein the controller is configured to receive data from the sensor, and wherein the controller is configured to use the data to determine the instruction to be transmitted to the motor wherein the force-transmitting linkage includes a Bowden cable, and wherein the Bowden cable is adapted to have a length which is substantially matched to a length of a leg of the user, such that when the leg is straight the Bowden cable is substantially straight between the lower assembly and the motor, and such that when the Bowden cable is straight the Bowden cable acts to partially support the weight of the device by providing resistance to compressive force between lower assembly and the motor.

2. The device of claim 1, wherein the joint includes a first arm, a second arm, and a rotational bearing coupled to the first arm and the second arm, the first arm is configured to be coupled to a lower leg by a cuff, and the second arm is configured to be coupled to a foot plate, a shoe, or a cam beneath the user's foot.

3. The device of claim 2, wherein the sensor is a pressure sensor, which generates a pressure measurement value; and wherein, when the pressure measurement value is greater than a threshold pressure measurement value, the controller is configured to cause the motor to apply a force along a length of the force-transmitting linkage in a first direction.

4. The device of claim 3, further comprising a second sensor, wherein the second sensor is a torque sensor coupled to the rotational bearing, which generates a torque measurement value, and wherein an amount of force applied by the motor along a length of the force-transmitting linkage in a first direction is at least partially determined by the torque measurement value.

5. The device of claim 3, wherein, when pressure measurement value less than the threshold pressure measurement value, the controller is configured to cause the motor to apply a force along the length of the force-transmitting linkage in a second direction.

6. The device of claim 3, wherein, when the pressure measurement value less than the threshold pressure measurement value, the controller is configured to prevent the motor from applying force along a length of the cable.

7. The device of claim 1, further comprising a disengagement mechanism configured to selectively disconnect the force-transmitting linkage from the lower assembly or the motor.

8. The device of claim 1, further comprising a housing and wherein the motor is disposed within the housing and the housing is configured to be worn proximate a waist of the user.

* * * * *